US005709268A

United States Patent [19]

Estilette, Sr.

[11] Patent Number: 5,709,268

[45] Date of Patent: *Jan. 20, 1998

[54] METHOD AND APPARATUS FOR JARRING

[76] Inventor: Felix F. Estilette, Sr., P. O. Box 39, Carencro, La. 70520

[ * ] Notice: The term of this patent shall not extend beyond the expiration date of Pat. No. 5,507,347.

[21] Appl. No.: 597,703

[22] Filed: Feb. 7, 1996

Related U.S. Application Data

[63] Continuation-in-part of Ser. No. 295,213, Aug. 24, 1994, Pat. No. 5,507,347.

[51] Int. Cl.[6] ..... E21B 31/107

[52] U.S. Cl. ..... 166/301; 166/178; 175/296

[58] Field of Search ..... 166/301, 178, 166/296, 300, 302

[56] References Cited

U.S. PATENT DOCUMENTS

| | | | |
|---|---|---|---|
| 2,122,751 | 7/1938 | Phipps | 255/27 |
| 3,203,482 | 8/1965 | Lyles | 166/178 |
| 4,333,542 | 6/1982 | Taylor | 175/299 |
| 4,844,157 | 7/1989 | Taylor | 166/178 |
| 4,846,273 | 7/1989 | Anderson et al. | 166/178 |
| 5,139,086 | 8/1992 | Griffith, Sr. | 166/178 |
| 5,327,982 | 7/1994 | Trahan et al. | 175/304 |
| 5,507,347 | 4/1996 | Estilette, Sr. | 166/301 |

*Primary Examiner*—William P. Neuder
*Attorney, Agent, or Firm*—C. Dean Domingue

[57] ABSTRACT

An apparatus and method for delivering a jarring action to an object in a well bore is disclosed. Generally, the apparatus comprises a cylindrical housing, with the cylindrical housing being connected to the stuck object; and, a power mandrel disposed within said cylindrical housing, with the power mandrel being threadedly connected to a work string. The invention also includes a latch member adapted to the housing, and a collet member having an end engageable with the latch. A conical member is adapted to set, reset and unlatch the engageable end of the collet. Also included will be an activation piston cooperating with the conical member.

14 Claims, 15 Drawing Sheets

METHOD AND APPARATUS FOR JARRING

BACKGROUND OF THE INVENTION

This application is a continuation-in-part of my patent application entitled "METHOD AND APPARATUS FOR JARRING", Ser. No. 08/295,213 filed Aug. 24, 1994, now U.S. Pat. No. 5,507,347. The invention relates to a device used in well bores. More particularly, but not by way of limitation, the invention relates to a down hole device used to deliver a jarring impact to objects within a well bore.

In order to produce hydrocarbons, a well bore is drilled until a subterranean reservoir is encountered. Once the drilling of the well bore has been completed, a casing string may be run into the well bore, and then cemented into place. As is understood by those of ordinary skill in the art, the subterranean reservoir can then be perforated to allow communication between the reservoir and the casing. Thereafter, the well may be completed, for instance, with the placement of gravel pack and a gravel pack screen. The well is then capable of producing the hydrocarbons.

For the drilling and completing of the well bores to the hydrocarbon reservoirs, different types of drill and completion strings may be employed. Historically, a drill string made up of a series of coupled drill pipe has been employed for rotary drilling. Recently, coiled tubing has been utilized for both the drilling and completion phase. The coiled tubing is generally of a smaller diameter tubular as compared to drill pipe, and moreover, is continuous e.g. lacks interconnecting tool joints. It should also be understood that the invention described herein is applicable to drill pipe, coiled tubing and other types of work strings such as wireline and electric line.

During the course of drilling, completing and producing the hydrocarbon reservoir, objects may become stuck within the well bore. Stuck objects within the well bores are sometimes referred to as "fish". In order to loosen these objects, jars have been developed that have the effect of providing a jolting impact to the object. Moreover, many wells being drilled include highly deviated and horizontal wells. During the course of drilling these wells, jarring impacts to the bottom hole assembly may be necessary in order to release the objects. Also, it may be necessary to set or unseat certain bottom hole assembly devices by providing jarring impacts. The invention described herein is applicable to all the above situations.

Several prior art jars have been developed. One of the first jars invented for use in well bores was U.S. Pat. No. 2,122,751 to J. T. Phipps in 1938. Other prior art devices include U.S. Pat. No. 3,203,482 to C. R. Lyles in 1965, U.S. Pat. No. 4,333,542 to W. T. Taylor in 1982, and U.S. Pat. No. 5,139,086 to J. M. Griffith.

Despite these prior art devices, problems exist. The prior art devices have been bulky and require large outer diameter housings in order to encase the necessary components. Thus, as well bores become longer and more deviated, the need for small diameter tools is very great. Also, the prior art devices suffer from not being able to accurately and dependably deliver the force required. This can result from the type of spring employed in many prior art devices. For instance, frusto-conical bellville washers can flatten due to use, and the amount of force required to activate the jar can lessens with repeated use. Also, coiled springs can break, completely disrupting the operation of the jar.

Therefore, there is a need for a jar that will function properly and effectively in small inner diameter holes. Also, there is a need for a jar that will have dependable and reliable predetermined amount of force that will activate the jar to cause an impact force on an object in the well.

SUMMARY OF THE INVENTION

A device to jar an object within a well bore is disclosed. Generally the device comprises a housing having a latch member and a anvil along with a power mandrel slidably disposed within said housing, the mandrel having a hammer. Also included will be engaging means for engaging and releasing the hammer for impact against the anvil from a latched position and operating means for resetting the hammer into the latched position. The device may also include biasing means for biasing said engaging means in a first direction. In one embodiment, a tension means for adjusting the tension in the biasing means is included.

In the preferred embodiment, the power mandrel also includes a spring adapted to urge the engaging means in a first direction; and, an end adapted to contact the operating means. The engaging means may comprise a collet member having a first end and a second end with the first end being disposed about the first portion of the power mandrel and a second end having protuberances cooperating with the operating means; a conical member disposed within the housing and set apart from the power mandrel; a locking leg adapted for cooperation with the conical member; and, detent means for locking the locking leg with the conical member.

In the preferred embodiment, the operating means will have an activation piston disposed within the conical member and wherein the activation piston contains a detent cavity adapted to cooperate with the detent means.

The apparatus may also contain a first spring adapted for urging the activation piston in a first position, and a second spring adapted for urging the locking member in a first direction. The housing may contain a window opening, and the tension means may comprise a threaded member adapted to engage the locking leg so that as the threaded member is rotated, the tension in the biasing means is adjusted.

A method of providing a jarring force to an object in a well bore is also disclosed. Generally, the method comprises the steps of lowering on a work string the novel jar disclosed herein. Generally, the jar contains a housing; a latch member adapted to the housing; a mandrel, slidably disposed within the housing and being connected to the work string; a collet member having a first end disposed about the mandrel and a second end engagable with the latch; a conical member adapted to engage the second engagable end of the collet member; a leg extension member selectively attachable to the conical member; and, an activation piston cooperating with the conical member and the leg extension.

The method further includes exerting a pulling force on the mandrel with the work string, which in turn will engage the collet engaging end against the latch. This will force the conical member in a downward direction relative to the latch. After an adequate amount of force has been applied, the collet will be released from engagement from the latch. The hammer will be simultaneously released to impact against the anvil.

The method may further comprise the steps of exerting a pushing force on the mandrel with the work string so that the second end of the collet engages the conical member and the latch member. Next, the conical member is moved in a downward direction relative to the latch which in effect will reset the second end of the collet against the latch member.

In one embodiment, the object is a stuck object within the well bore and the work string is a coiled tubing string. In this case, the method further comprises the steps of exerting a pulling force on the mandrel with the coiled tubing string. This will engage the collet engaging end against the latch. The continued pulling will force the conical member in a downward direction relative to the latch which in turn will release the collet engaging end from the latch. Thereafter, the hammer will travel instantaneously and impact the anvil so that a jarring action is transferred to the stuck object.

A feature of the present invention includes a latch mechanism that is on the housing and a collet that cooperates with the latch. Another feature includes a conical member that is adapted to engage with the collet. Yet another feature includes an activation piston adapted to release the conical member.

Another feature includes the detent means for locking the locking leg with the conical member. Still yet another feature includes a mandrel and an activation piston that are detached from each other and longitudinal movement of the mandrel is necessary to activate the piston.

An advantage of the invention is the option of manufacturing smaller outer diameter tools for use in small inner diameter well bores. Another advantage is that the jar may be set and reset (after firing) as often as desired by the operator. Another advantage is that resetting is more reliable than prior art designs. Yet another advantage is that the jar will function in highly deviated and horizontal wells. Still yet another advantage is that the tension in the biasing means may be adjusted at the rig site.

Another advantage of the present invention includes having a more predictable force requirement for detaching the collet end from the catch located on the housing. Another advantage includes being able to reset multiple times without fatigue of the biasing means. Another advantage is the minimum number of parts that make-up the invention thereby making the invention an uncomplicated and workable invention that requires little field maintenance. Still yet another advantage is the stroke length of the jar is twenty inches.

DESCRIPTION OF THE PREFERRED EMBODIMENTS

Figure 1:
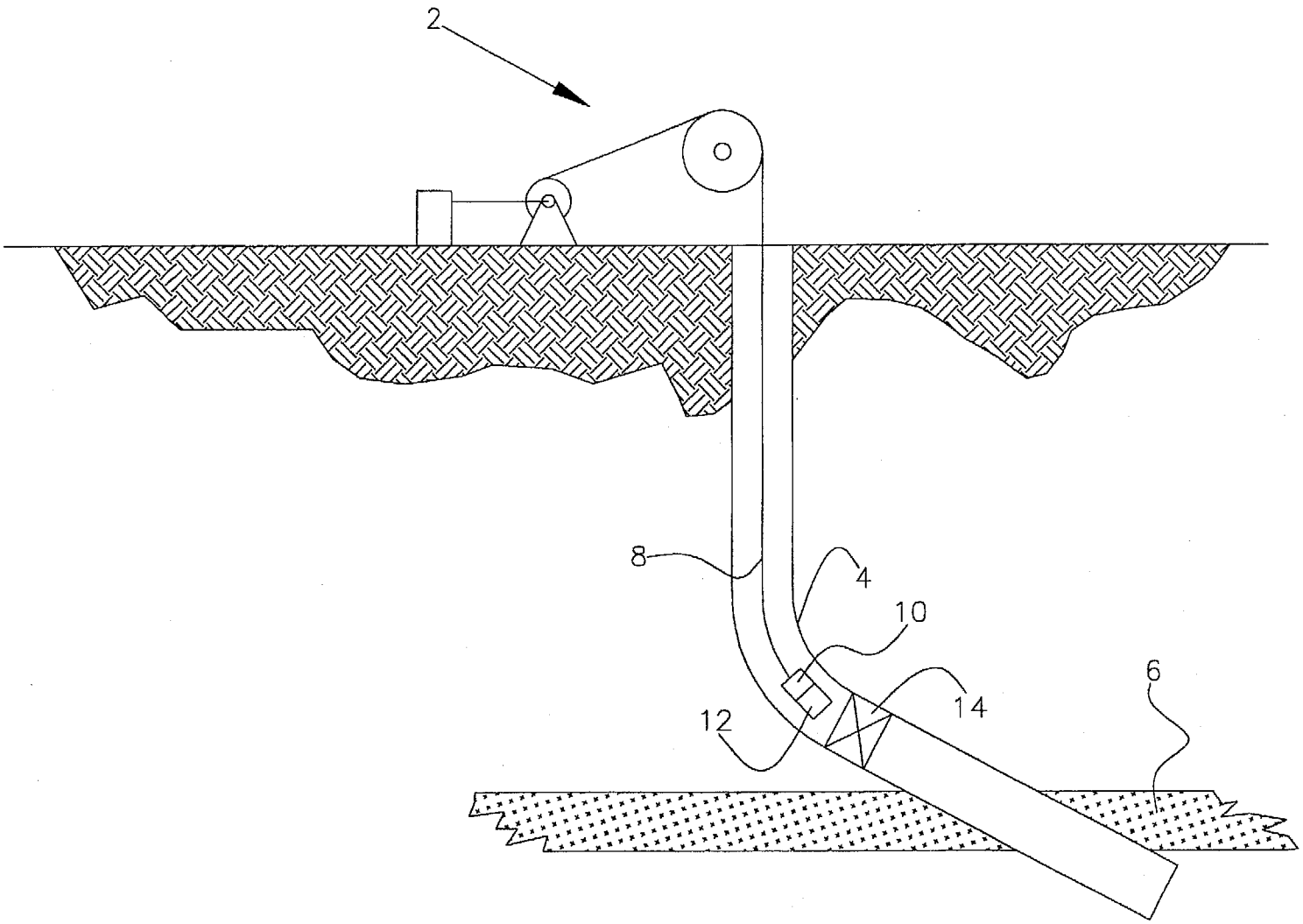
FIG. 1 is schematic of a typical wire line unit used for work in a well bore.

Referring to FIG. 1, a typical wire line unit 2 is shown operating in a well bore 4, which in the figure shown is a casing string as will be appreciated by those of ordinary skill in the art. The well bore 4 will intersect an subterranean reservoir 6 that will contain hydrocarbons.

The wire line unit 2 will have extending therefrom a work string 8 that will have attached thereto a bottom hole assembly 10. As seen in FIG. 1, the bottom hole assembly has attached thereto the jar apparatus 12 of the present invention. The jar apparatus will in turn be connected to an object, which may be a stuck object such as a packer. It should be understood that the apparatus of the present invention is applicable to various types of work strings such as conventional drill pipe, as well as snubbing tubing, wireline, coiled tubing and electric line. Moreover, the apparatus may be used to provide a jarring impact to objects such as packers and setting tools.

Referring now to FIGS. 2A–2D, the preferred embodiment of the present invention will now be described. While the invention is applicable to various work strings such as coiled tubing, the embodiment shown is specially adaptable to wire line. The apparatus will require only minor modifications from the embodiment shown in FIGS. 2A–2C for through tubing use such as coiled tubing by providing a bore hole through the inner diameter of the mandrel.

Figure 2A:
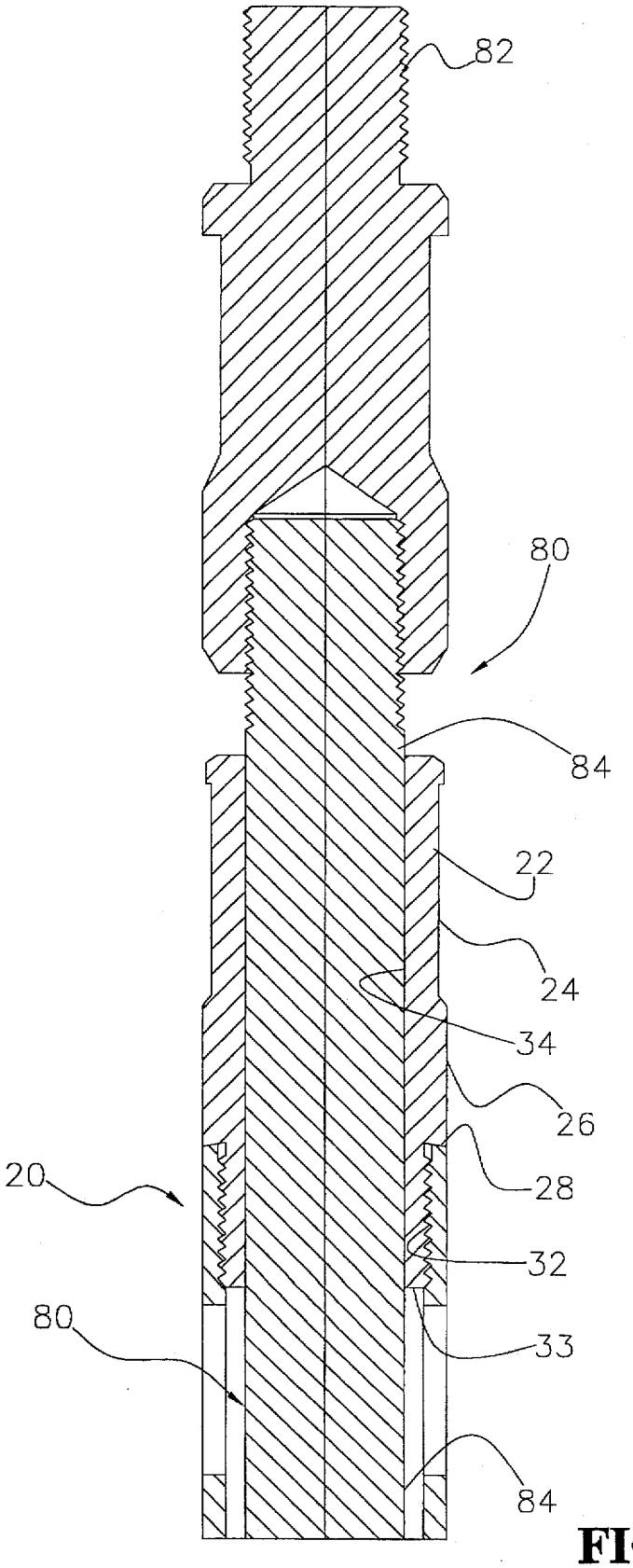
FIGS. 2A–2D are partial cut-away views of the apparatus of the present invention.
Figure 2B:
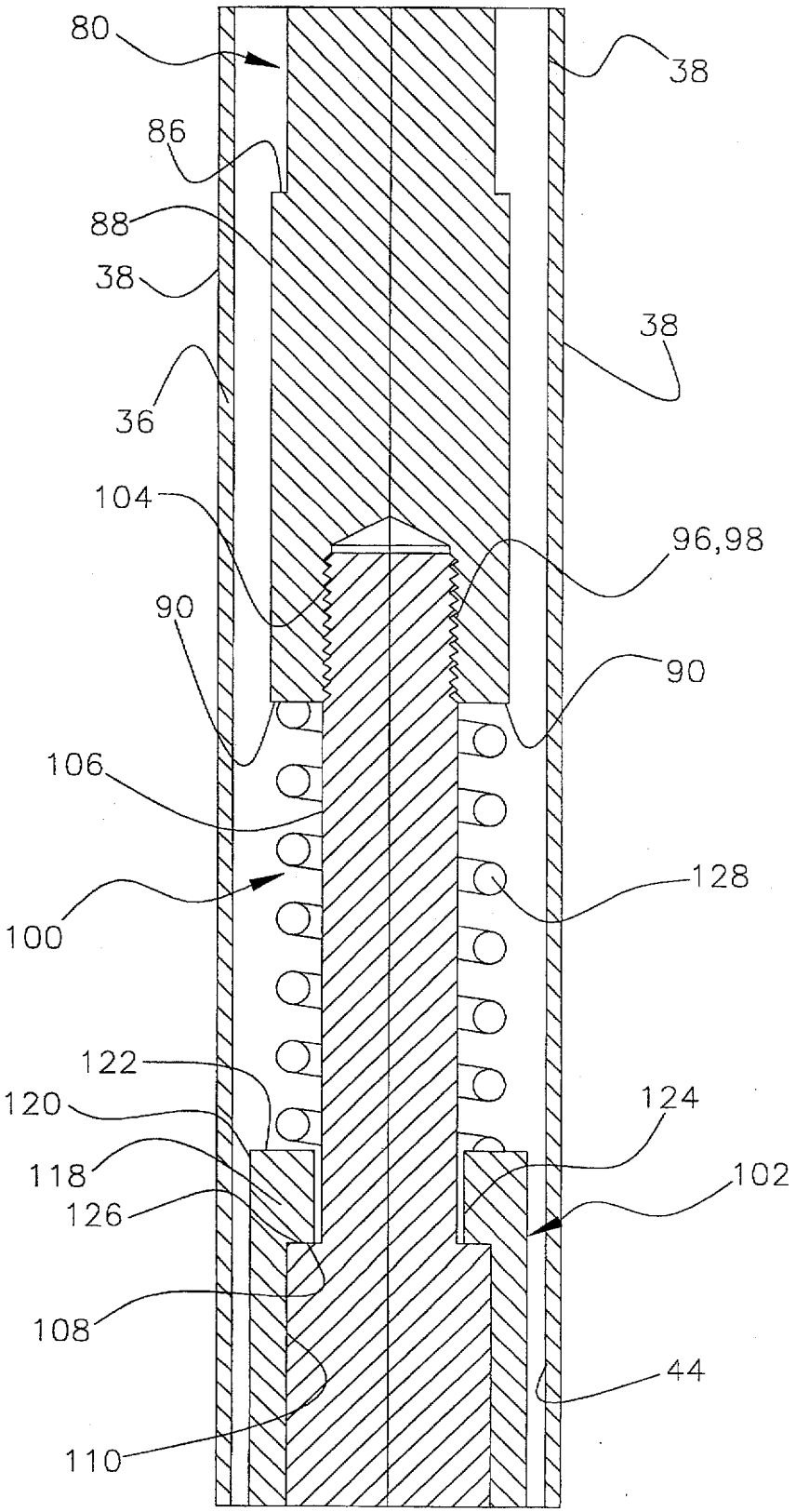

Referring to FIG. 2A, the cylindrical housing 20 comprises a first section 22 that is a fishing neck 22 that has a recessed surface 24, that leads to cylindrical surface 26, with cylindrical surface terminating at radial surface 28. The radial surface extends to the cylindrical surface 30, with the surface 30 having contained thereon external thread means 32 and concluding on anvil shoulder 33. The first section 20 contains an inner diameter portion 34.

The second section 36 of the cylindrical housing 20 will now be described. A connecting sub for connecting section 22 with section 36 is not shown. The second section 36 has a cylindrical outer body 38 that extends to the generally radial surface 40 which in turn extends to the internal thread means 42, with the thread means 42 stretching to the inner diameter bore 44. The bore 44 will through the latch means **45*a*. The latch means 45*a* comprises a first angled surface 45*b* that in turn leads to the circumference point 45*c* which then extends to chamfered surface 45*d*. The bore 44** continues thereafter.

Figure 2C:
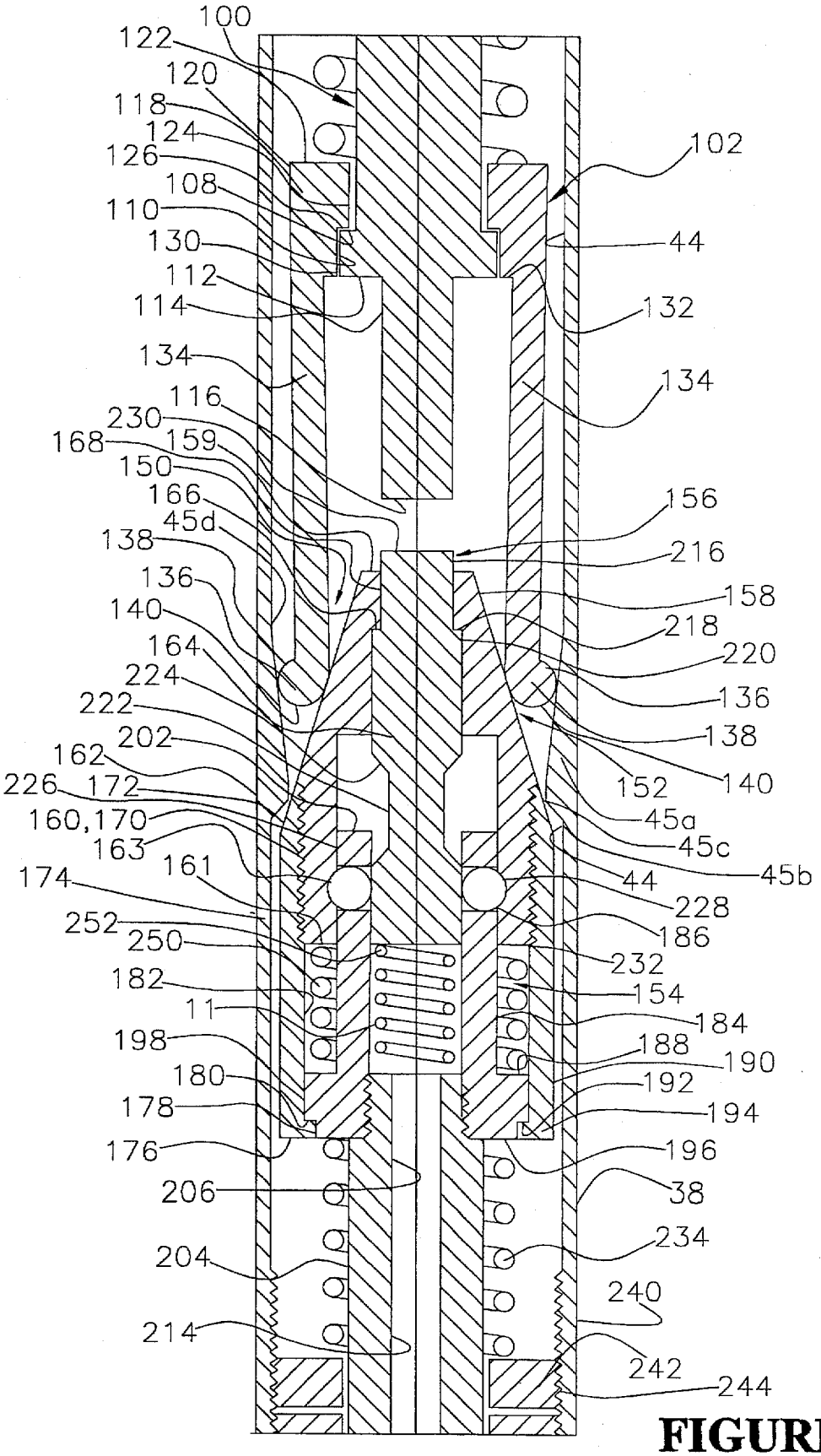
Figure 2D:
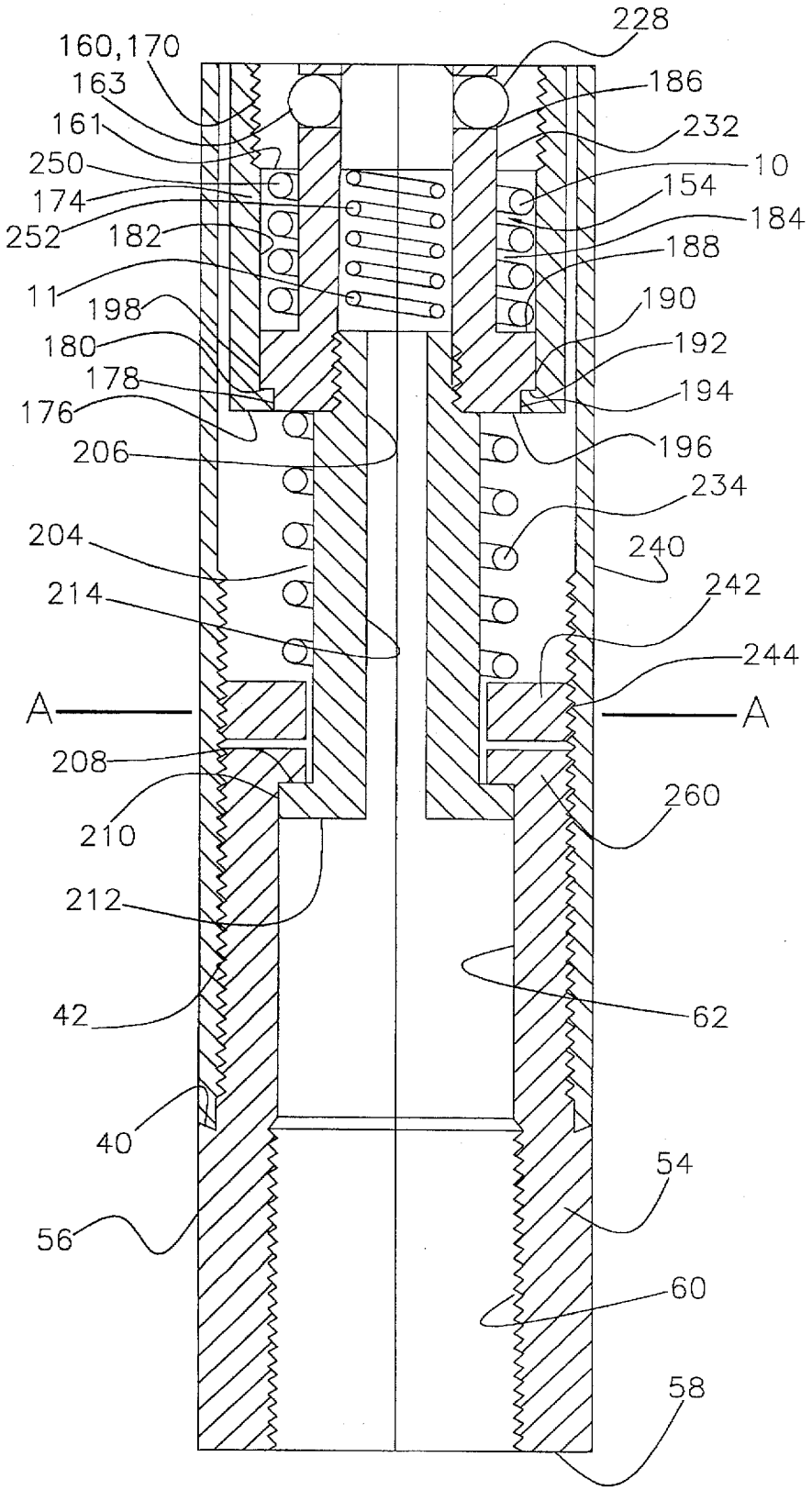
Figure 3A:
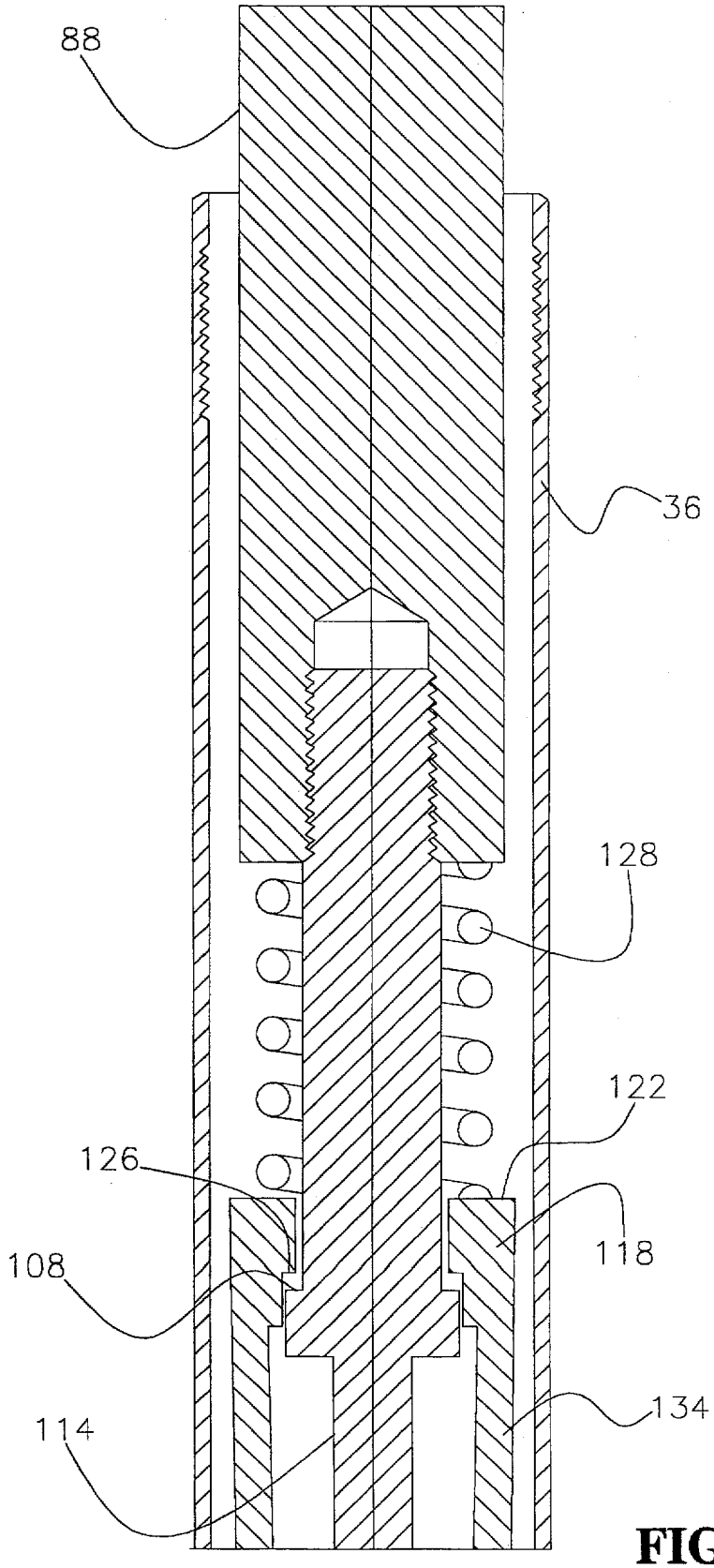
FIGS. 3A–3B are partial cut-away views of the apparatus in the process of the latching the collet member.
Figure 3B:
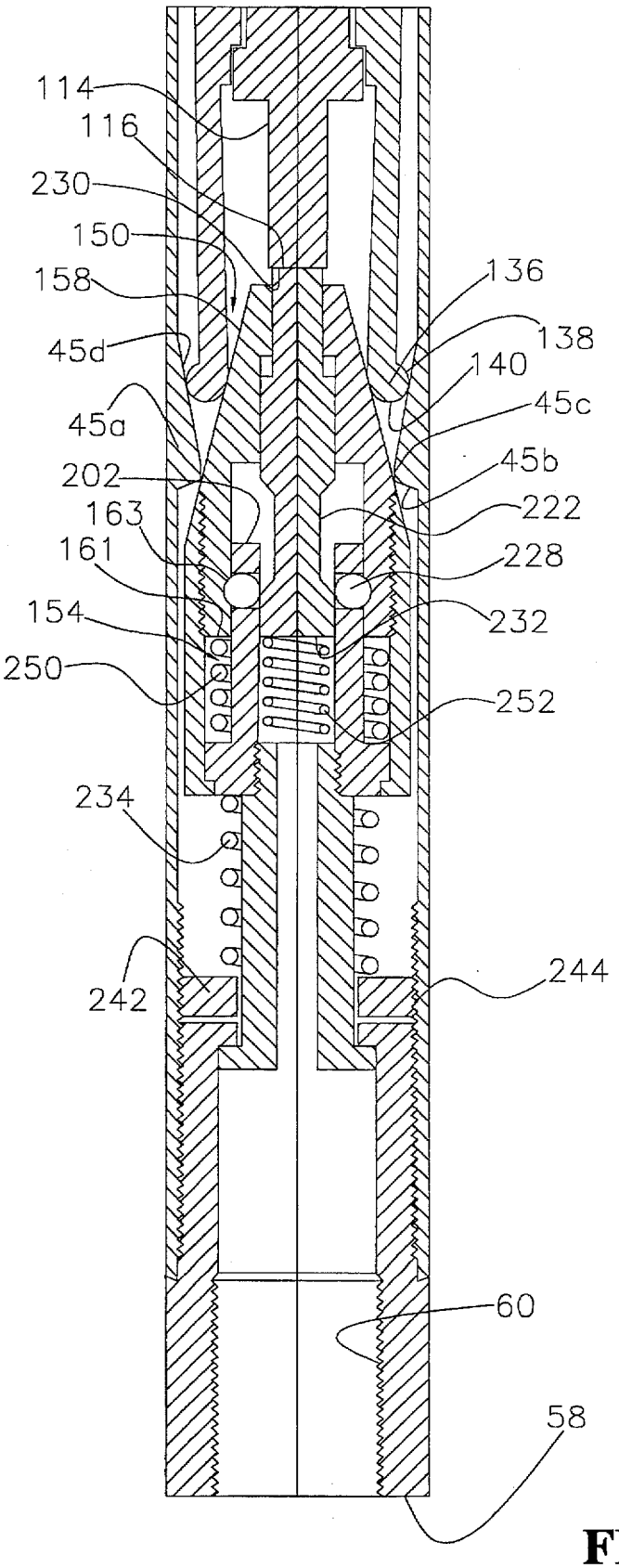

The third section 54 of the cylindrical housing 20, as seen in FIG. 2C, includes and outer surface 56 that terminates at the radial shoulder 58, that in turn extends to internal threads 60. The threads 60 stretches to inner bore 62. Generally, the thread means 60 may be attached to the fish. Other means of attaching to the fish are available such as over-shots.

The power mandrel, seen generally at 82 in FIG. 2A, will now be described. The power mandrel 80 will have external thread means 82 at the first end of the mandrel 80, with the external thread means 82 that in turn extends to the cylindrical surface 84. The surface 84 extends to radial shoulder 86 (known as the hammer) that in turn terminates at the cylindrical surface 88 which in turn terminates at the radial shoulder 90 that extends to the cylindrical surface 92.

The surface 88 will conclude at the radial surface 90 with the radial surface 90 containing a cavity 96, with the cavity 96 containing internal thread means 98 that will be threadedly connected to the operator mandrel 100. The operator mandrel 100 will have disposed about it a collet member 102 that makes up a part of the attachment means for attaching the operator mandrel 100 to the cylindrical housing body 20.

The operator mandrel 100 generally comprises external thread means 104 that extends to the outer cylindrical surface 106 which in turn terminates at the shoulder 108. The shoulder 108 extends to the cylindrical surface 110 which in turn extends to the shoulder 112 which stretches to the cylindrical surface 114 which terminates at the end 116.

The collet member 102 generally comprises a top ring member 118 that includes a cylindrical outer surface 120 that extends to the radial surface 122 which in turn leads to the inner bore surface 124 that contains the shoulder 126. The shoulder 126 and shoulder 108 of the mandrel 100 will abut one another due to the collet spring 128. The shoulder terminates at the second inner bore 130 which then leads to the radial surface 132. The ring member 118 will have the collet tines 134, with the individual tines 134 stretching to the protuberance end 136. As shown, the protuberance has an angled surface 138 whereas the posterior surface 140 is more rounded. The surface 136 and 138 aid in the release and resetting of the collet member 102 as will be more fully explained later in the application.

The collet member 102 will be operatively associated with the engaging means, seen generally at 150, for setting, resetting and releasing said collet member 102. Generally, the engaging means 150 comprises the collet 102, the conical member 152, the cone extension 154, and the detent means 163, 228. The operating means, seen generally at 156, for selectively detaching said conical member 152 with the leg extension 154. The operating means 156, which cooperates with the engaging means 150 as will be more fully set out, includes an activation piston 156 disposed with the conical member, and a detent cavity 222.

The conical member 152 will have an upper unit including outer conical surface 158 with the top end 159 that extends to the external thread means 160 that extends to the flat surface 161 and first inner bore surface 162 which in turn leads to the second inner bore surface 164. The second inner bore surface 164 terminates at the radial shoulder 166 which then extends to the third inner bore surface 168. The lower unit of the conical member 152 includes internal thread means 170 that stretches to the conical surface 172 which in turn leads to the cylindrical surface 174. The surface 174 terminates at the radial surface 176 which then leads to the bore surface 178, with the bore surface 178 leading to the inner radial shoulder 180 which in turn extends to the inner bore surface 182.

The leg extension 154 contains an upper unit and a lower unit wherein the upper unit contains an outer cylindrical surface 184 that contains the aperture 186. The cylindrical surface 184 extends to the radial shoulder 188 which then leads to the cylindrical surface 190 which then advances to the shoulder 192, surface 194 and radial surface 196. Extending radially inward will be the internal threads 198 that then advance to the smooth inner bore 200, and flat surface 202.

The lower unit of the leg extension 154 will include a first outer cylindrical surface 204 that extends to the external threads 206 on one side and to the radial shoulder 208 which in turn leads to the second outer cylindrical surface 210. Extending radially inward will be the flat surface 212 which in turn leads to the inner bore 214.

The operating means 156 normally comprises an activation piston that contains a first outer cylindrical surface 216 that extends to the radial shoulder 218 that in turn extends to the second outer cylindrical surface 220. The second outer surface 220 will contain therein a detent means 222 that contain angled sides 224, 226 for cooperation with the detent members 228 which in the illustration is locking balls 228. The piston 156 has a first end 230 and second end 232. As seen in FIG. 2C, a biasing means 234 for biasing the leg extension 154 is disposed about the leg extension 154 and in particular the cylindrical surface 204.

Figure 7:
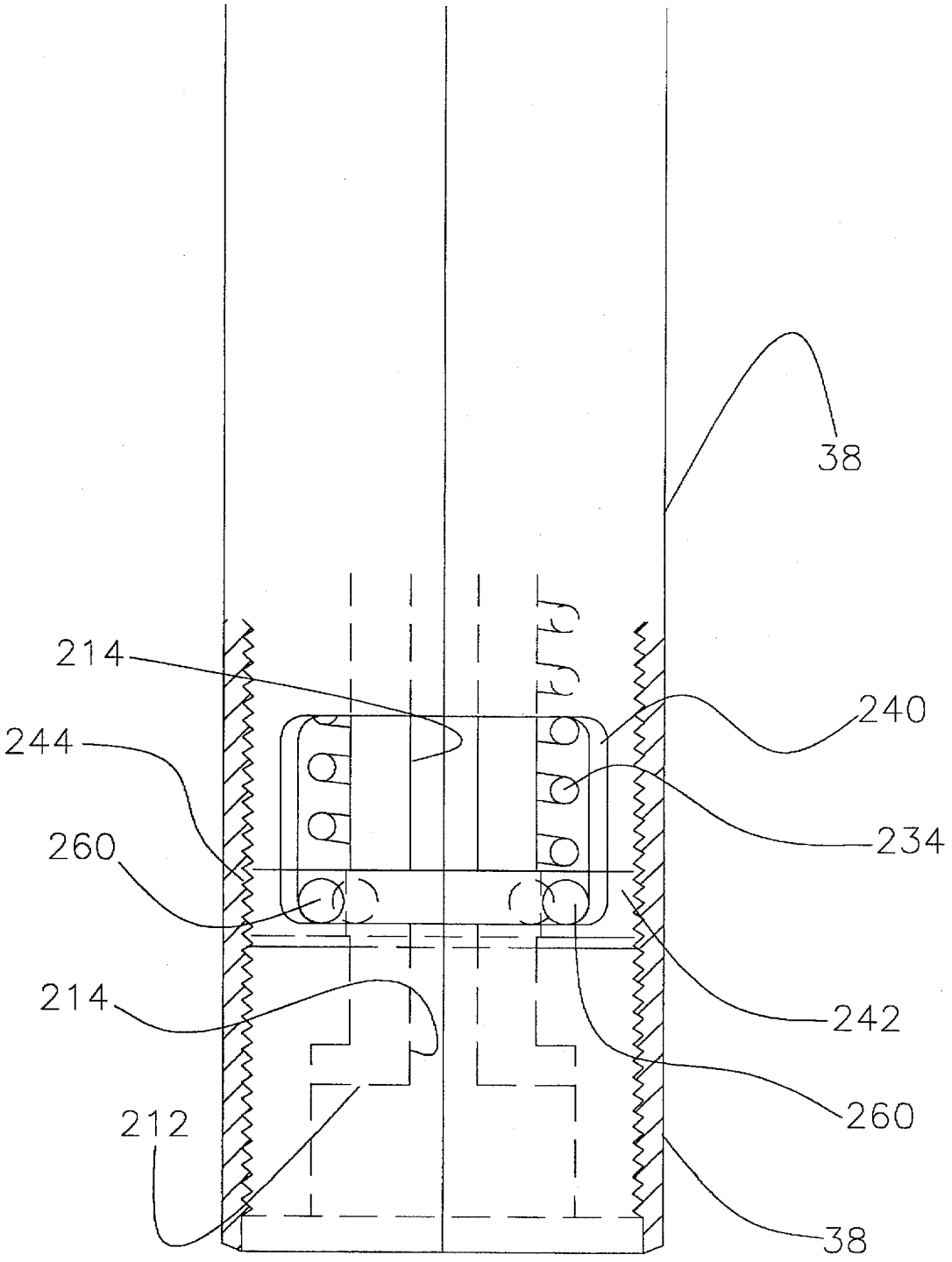
FIG. 7 is a partial cut-away view of the means for adjusting the biasing means.
Figure 8:
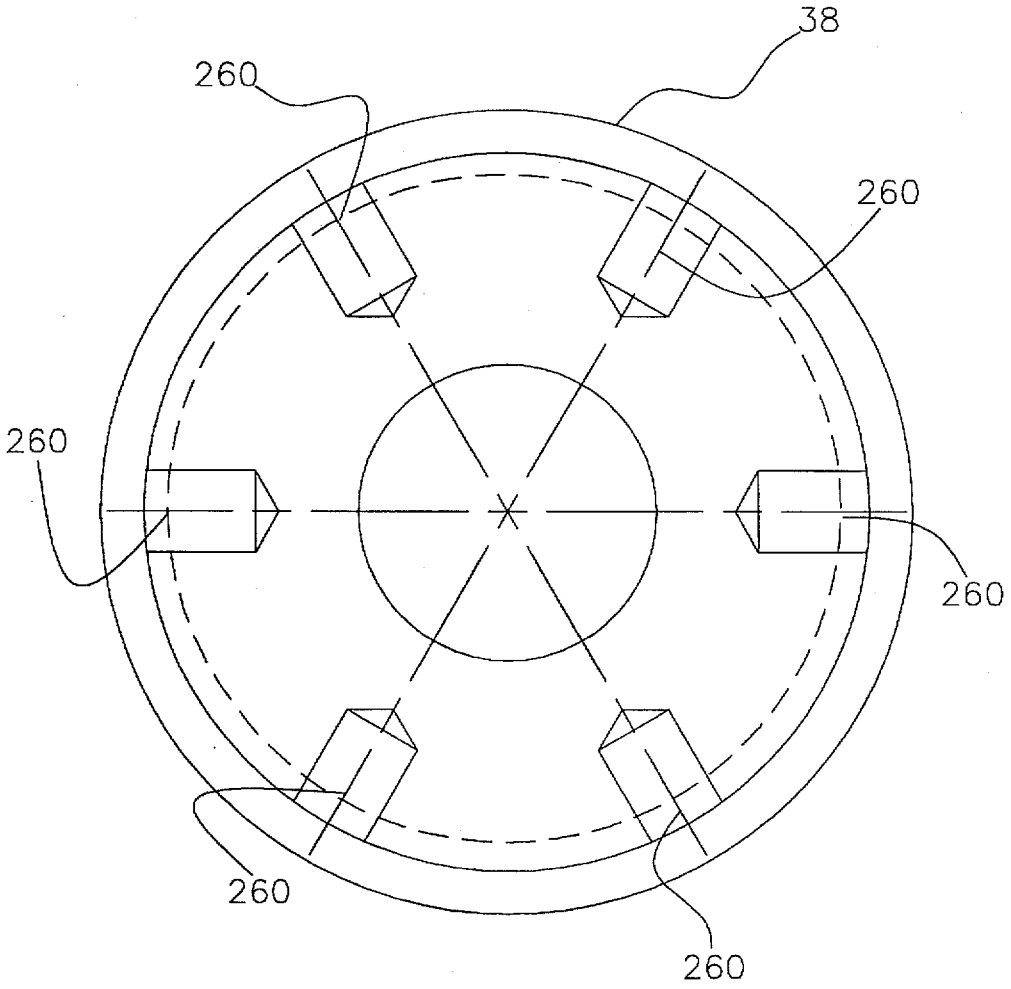
FIG. 8 is a cross-section view of line A—A from FIG. 2D.

The apparatus will also contain tension means for adjusting the tension in the biasing means 234, as seen in FIG. 7. The cylindrical housing 38 will have a window 240 cut therethrough. An adjusting tension nut 242 will be disposed about the leg extension 154 and in particular the cylindrical surface 204. The tension nut 242 will have at the outer cylindrical surface external thread means 244 that will cooperate with the internal thread means 42 of the outer housing 38. The tension nut 242 will have a series of grooves formed on the outer cylindrical surface. Thus, in use, the operator will use a key which will be stuck through the window 240 and into the cavities 260. The key is inserted into the groove and turned; therefore, with right hand rotation the nut will travel longitudinally upward relative to the operating means 150 so that the tension in the biasing means 234 is increased. Left hand rotation of the tension nut 242 by means of the key will cause the tension nut 242 to travel downward relative to the operating means 150 so that tension in the biasing means 234 is decreased.

The apparatus herein disclosed also contains a cone spring means 250 for urging the conical member 152 longitudinally upward relative to the collet member 102. Also included will be the operating means 156 release spring 252 which will engage the second end 232 and urge the detaching means 156 upward relative to the leg extension member 154.

The operation of the present jar apparatus 12 will now be described. Referring to FIGS. 2A–2D, the jar is in the extended or open position which represents the state after the jar 12 has been allowed to release. Thus, the mandrel 80 and in turn the operator mandrel 100 are lowered slowly. This will also have the effect of lowering the collet member 102 since the collet spring 128 will act to urge the ring member 118 down. The lowering process will continue until the protuberance end 136 of the collet member 102 makes contact with the outer conical surface 158 and the latch means 45*a*. Note the posterior surface 140 makes contact with the conical surface 158; this is important since by changing the angles of both surfaces 140 and 158, the amount of force to re-latch will be effected.

Additional lowering of the jar 12 and in particular the operator mandrel 100, collet member 102, and collet tines 134 will cause the collet spring 128 to compress. Also, at this point the downward movement of the tines 134 has effectively stopped. Nevertheless, due to the novel design the operator mandrel 100 and end 116 continue longitudinally downward relative to the engaging means 150. This downward movement will continue until the end 116 of the operator mandrel 100 contacts the operating means 156, and in particular, the activation piston end 230. Further downward movement of the operator mandrel 100 will over power the release spring 252 so that the detaching means 156 continues its downward movement. Note that the detent means cavity 222 is also moving downward.

Figure 4A:
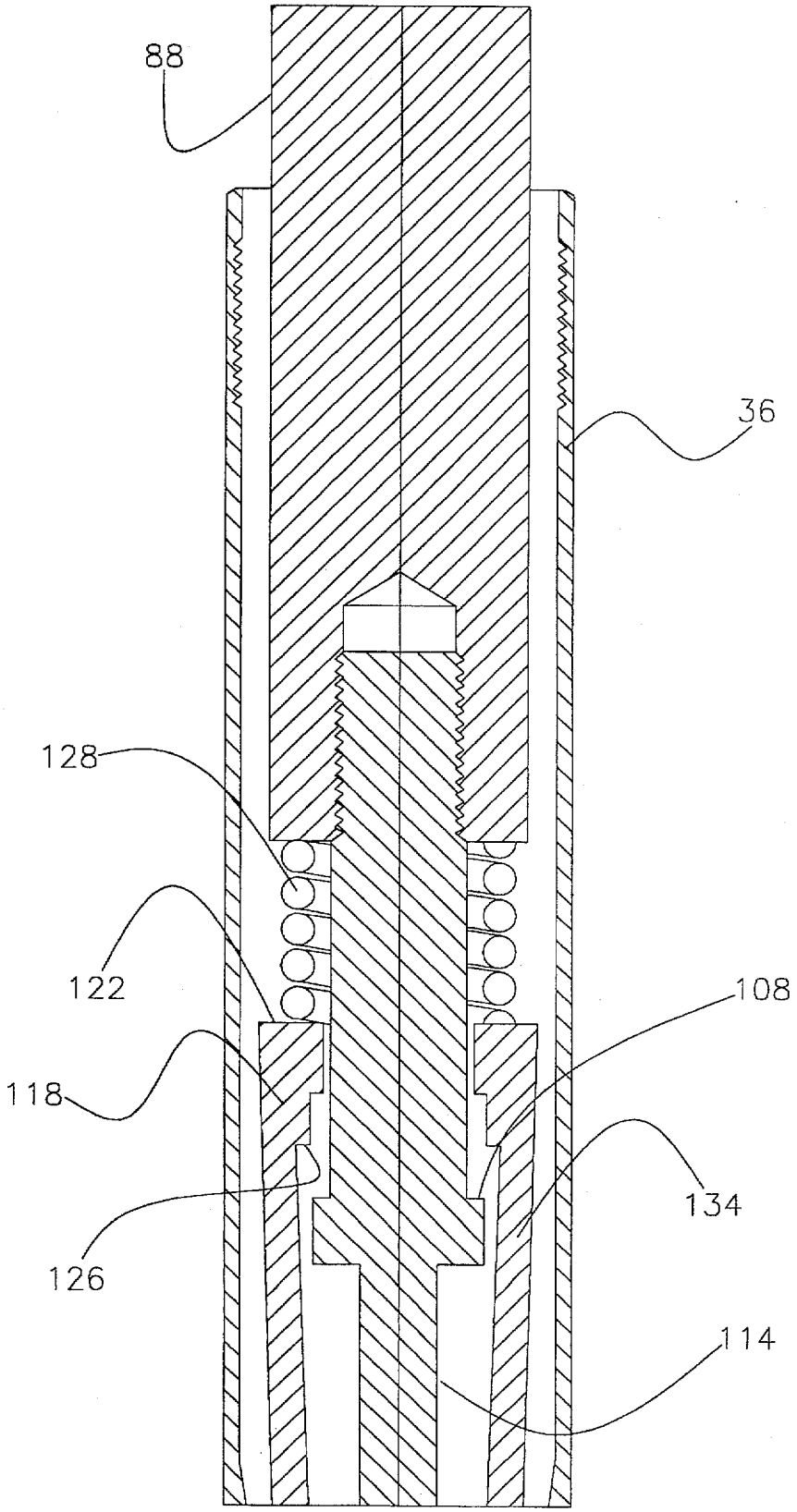
FIGS. 4A–4B are partial cut-away views of the apparatus continuing in the process of latching the collet member.
Figure 4B:
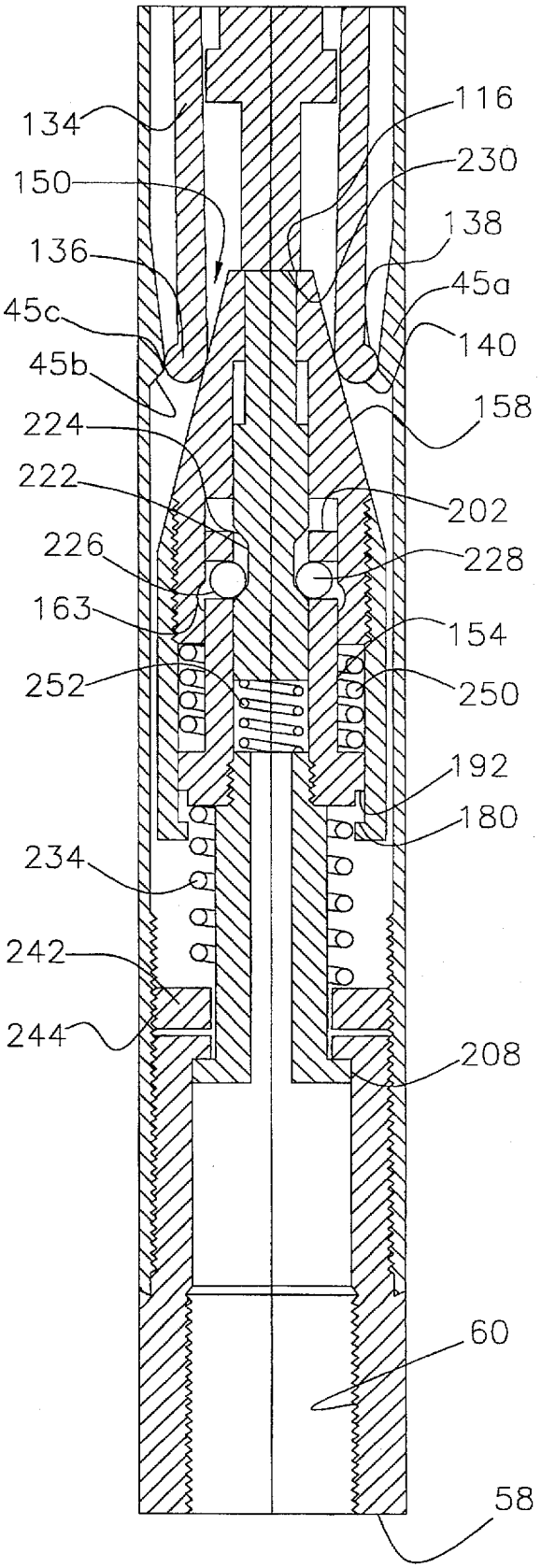

As seen in FIG. 4B, when the end 116 and the activation piston end 230 have moved sufficiently downward so that the end 116 contacts the end 159 of the operating means 150, the detent members 228 are free to move into the detent means cavity 222. The operating means 150, and in particular the conical member 152 are release in order to move down against the cone spring 250. As seen in FIG. 4B, both the cone spring 250 and release spring 252 are compressed.

Figure 5A:
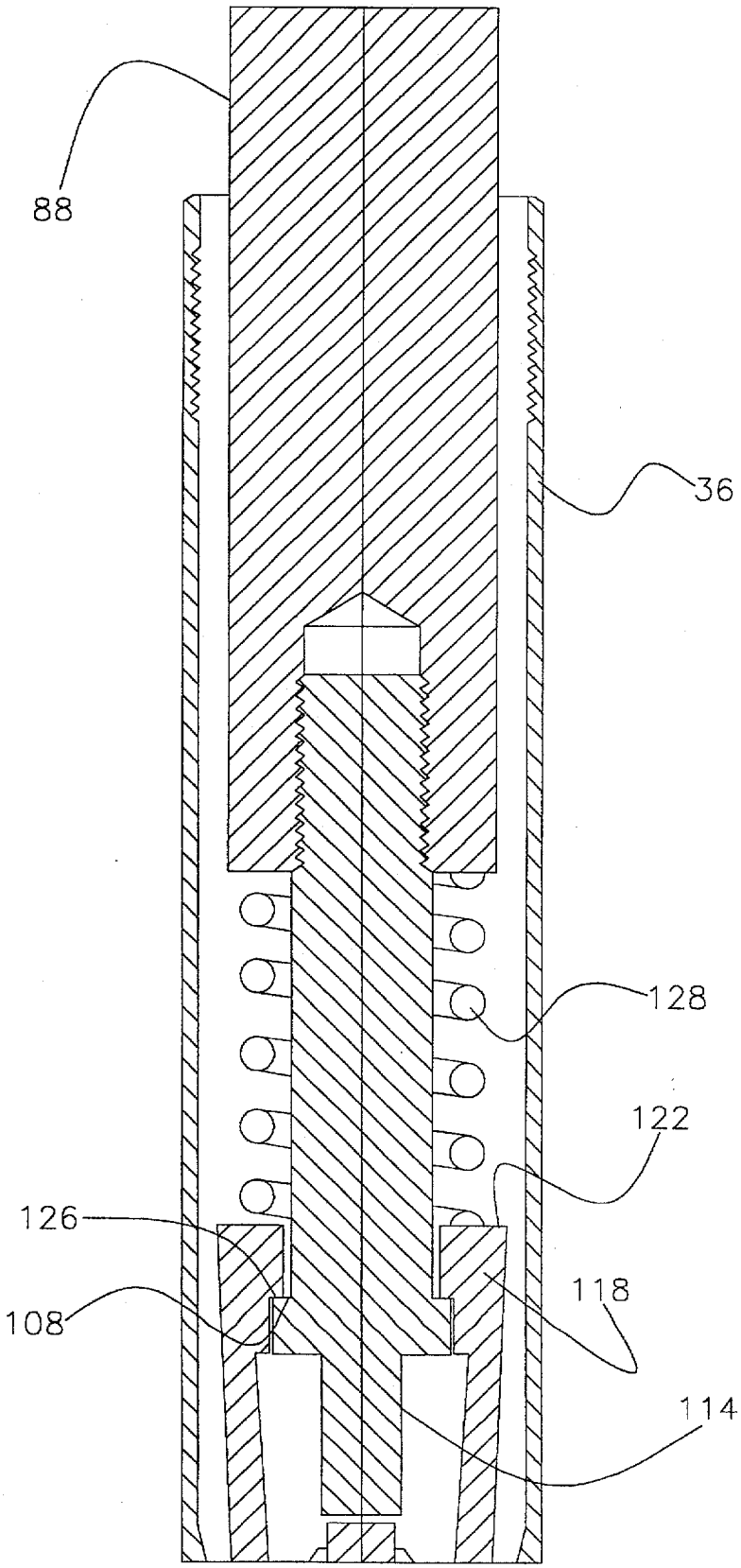
FIGS. 5A–5B are partial cut-away views of the apparatus in the latched position.
Figure 5B:
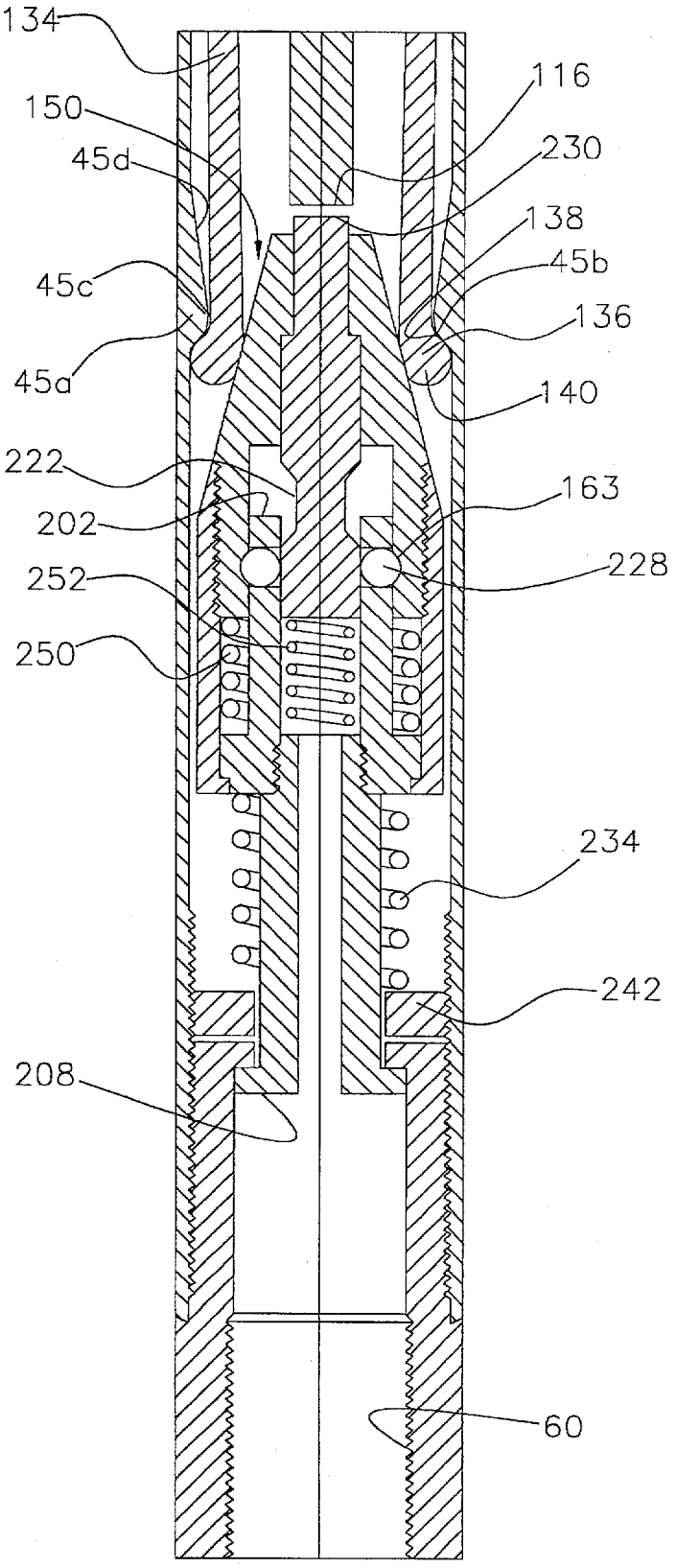
Figure 6A:
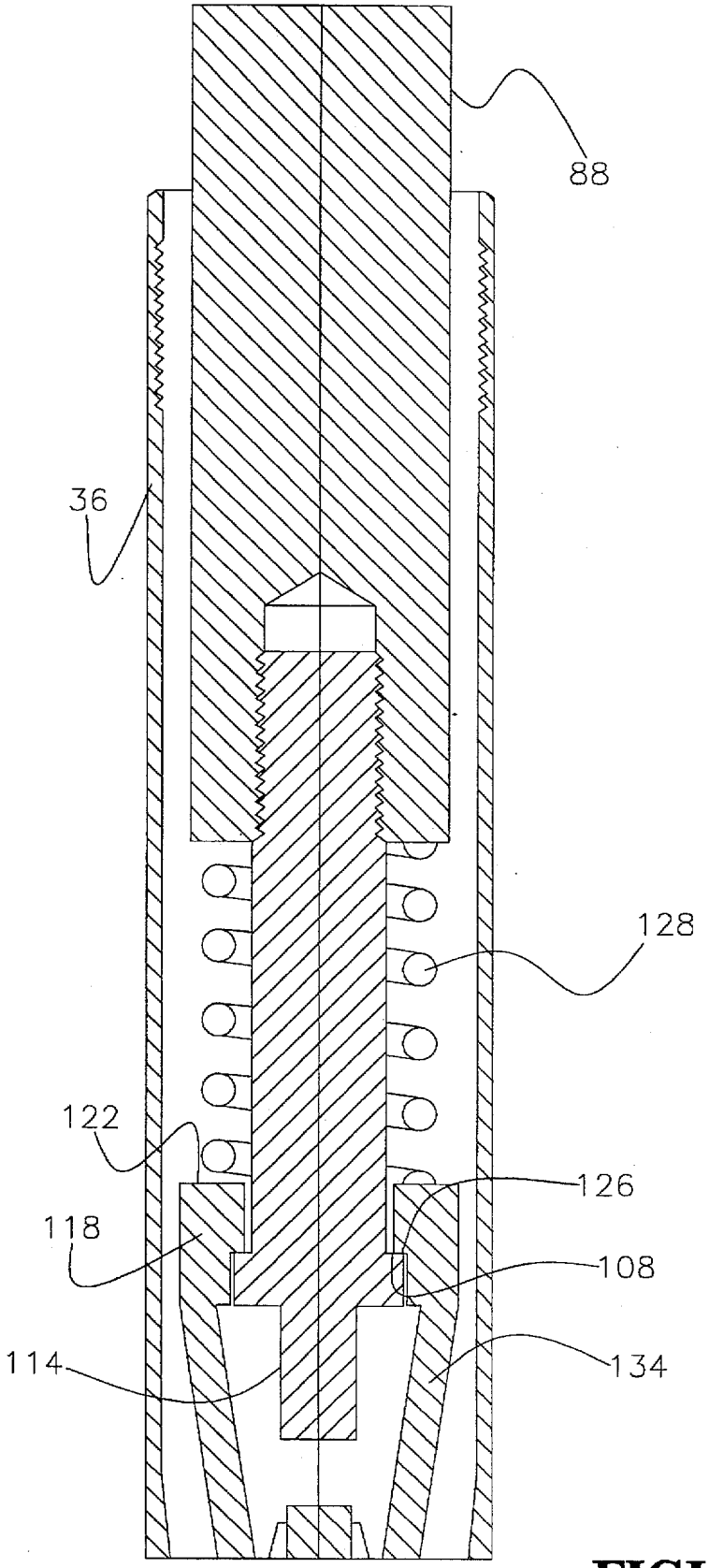
FIGS. 6A–6B are partial cut-away views of the apparatus at the point of release of the collet member.
Figure 6B:
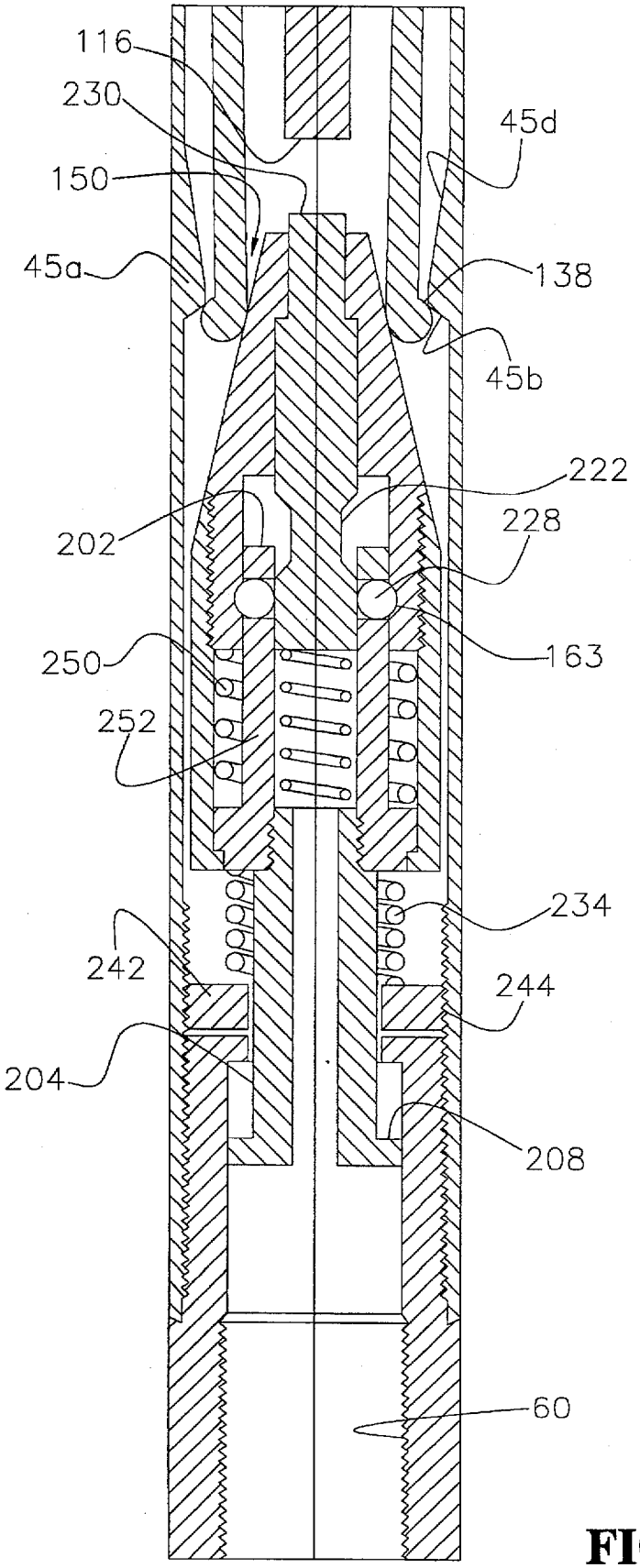

Thereafter, the operating mandrel 100, collet spring 128, operating means 156, conical member 152 and the cone extension 154 will all move down as a unit until there is enough space between the latch means 45*a*, and in particular the circumference point 45*c*, and the outer conical surface 158 as illustrated in FIGS. 5A–5C to enable the protuberance end 136 to get below the angled surface 45*c* of the latch means 45*a*. Also, the detent members 228 have fallen into place within the groove 163 so that the cone member and cone extension 154 are again locked together. In the position shown in FIG. 5B, the jar apparatus 12 is in the latched position.

The cone extension 154 will prevent the upward movement of the conical member 152 which is tensioned by the cone spring 250 and by the shoulder 208 of the cone extension acting against the shoulder 260 of the bottom sub of the housing 54.

In order to jar an object in the well bore, the operator would begin pulling on the work string which in turn cause the operating mandrel 100 to also pull on the collet tines 134. Once a predetermined force is pulled, the protuberance end 136 will become disengaged with the latch means 45*a* allowing the hammer 86 to travel rapidly and strike the anvil 33 thereby delivering a jarring impact to the object in the well bore. Thereafter, the jar 12 may be re-latched as previously explained.

The tension exerted against the conical member 152 by the biasing means 234 is controlled by the tension nut 242. The nut 242 is adjusted by insertion of a bar or rod into cavities 260 drilled in the side of the nut 242 and turned clockwise in the window 240 milled in the lower housing 5 as illustrated in FIG. 7.

Changes and modifications in the specifically described embodiments can be carried out without departing from the scope of the invention which is intended to be limited only by the scope of the appended claims.

I claim:

1. An apparatus for jarring comprising:

a housing having a latch member and a anvil;

a power mandrel slidably disposed within said housing, said mandrel having a hammer, and wherein said power mandrel includes: a spring adapted to urge said engaging means; and, an end adapted to contact said operating means;

engaging means for engaging and releasing said hammer for impact against said anvil from a latched position, and wherein said engaging means comprises: a collet member having a first end and a second end with the first end being disposed about said first portion of said power mandrel and a second end having protuberances cooperating with said operating means; and, a conical member disposed within said housing and set apart from said power mandrel; a locking leg adapted for cooperation with said conical member; detent means for locking said locking leg with said conical member;

operating means for resetting said hammer into said latched position;

biasing means for biasing said engaging means in a first direction;

tension means for adjusting the tension in said biasing means.

2. The apparatus of claim 1 wherein said operating means comprises:

an activation piston disposed within said conical member; and, a detent cavity adapted to cooperate with said detent means.

3. The apparatus of claim 2 further comprising:

a first spring adapted for urging said activation piston in a first position;

a second spring adapted for urging said locking member in a first direction.

4. The apparatus of claim 3 wherein said housing contains a window opening, and said tension means comprises:

a threaded member adapted to engage said locking leg so that as said threaded member is rotated, the tension in said biasing means is adjusted.

5. The apparatus of claim 4 wherein said housing is connected to stationary object in a well bore.

6. The apparatus of claim 5 wherein said power mandrel is connected to a work string.

7. A device to jar an object within a well bore comprising:

a cylindrical housing having an anvil formed thereon, with said housing being connected to the object;

a latch member adapted to said housing;

a power mandrel being slidably disposed within said housing, said power mandrel having formed thereon a shoulder which is adapted to strike said anvil;

a collet member having a first end being slidably disposed on said power mandrel, and a second end cooperating with said latch member so that said second end is in a latched position;

a conical member, disposed within said housing, adapted to cooperate with said second end of said collet member;

operating means for positioning said collet member in said latched position, and wherein said operating means includes:

an activation piston disposed within said conical member; and, a detent cavity; and, biasing means for biasing said resetting means against said latch member.

8. The device of claim 7 further comprising:

a collet spring adapted to urge said collet member in an extended position;

a piston spring adapted to urge said activation piston in an extended position;

a cone spring adapted to urge said conical member into engagement with said second end of said collet member.

9. The device of claim 8 wherein said conical member includes a locking leg adapted for cooperation with said conical member; and the device further comprises:

detent means for locking and unlocking said locking leg with said conical member;

and wherein said detent cavity is adapted to energize the unlocking of said locking leg.

10. The device of claim 9 further comprising:

tension means for adjusting the tension is said biasing means.

11. The device of claim 10 wherein said power mandrel is attached to a work string means for creating a pull force transmitted to said power mandrel.

12. A method of providing a jarring force to an object in a well bore comprising the steps of:

lowering on a work string a jar containing: a housing; a latch member adapted to said housing; a mandrel, slidably disposed within said housing and being connected to said work string; a collet member having a first end disposed about said mandrel and a second end engagable with said latch; a conical member adapted to reset said second engagable end of said collet member; a leg extension member selectively attachable to said conical member; and, an activation piston cooperating with said conical member and said leg extension;

exerting a pulling force on said mandrel with said work string;

engaging said collet engaging end against said latch;

forcing said conical member in a downward direction relative to said latch;

releasing said collet engaging end from said latch;

impacting said hammer against said anvil.

13. The method of claim 12 further comprising the steps of:

exerting a pushing force on said mandrel with said work string so that said second end engages said conical member and said latch member;

moving said conical member in a downward direction relative to said latch;

resetting said second end of said collet against said latch member.

14. The method of claim 13 wherein said object is a stuck object within a well bore and said work string is a coiled tubing string, and wherein said method further comprising the steps of:

exerting a pulling force on said mandrel with said coiled tubing string;

engaging said collet engaging end against said latch;

forcing said conical member in a downward direction relative to said latch;

releasing said collet engaging end from said latch;

impacting said hammer against said anvil so that a jarring action is transferred to said stuck object.

* * * * *